US009272320B2

(12) United States Patent
Carpenter et al.

(10) Patent No.: US 9,272,320 B2
(45) Date of Patent: Mar. 1, 2016

(54) CEMENTED CARBIDE PUNCH

(75) Inventors: Michael Carpenter, Warwickshire (GB); Jane Smith, Conventry (GB)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 312 days.

(21) Appl. No.: 13/876,169

(22) PCT Filed: Oct. 5, 2011

(86) PCT No.: PCT/EP2011/067359
§ 371 (c)(1), (2), (4) Date: Mar. 27, 2013

(87) PCT Pub. No.: WO2012/045761
PCT Pub. Date: Apr. 12, 2012

(65) Prior Publication Data

US 2013/0247641 A1 Sep. 26, 2013

Related U.S. Application Data

(60) Provisional application No. 61/392,761, filed on Oct. 13, 2010.

(30) Foreign Application Priority Data

Oct. 7, 2010 (EP) ..... 10186875

(51) Int. Cl.
*B21D 22/20* (2006.01)
*C22C 29/08* (2006.01)
*B22F 5/00* (2006.01)

(52) U.S. Cl.
CPC ..... *B21D 22/20* (2013.01); *C22C 29/08* (2013.01); *B22F 2005/002* (2013.01)

(58) Field of Classification Search
CPC ..... B21D 37/01; B21D 37/20; B21D 37/205
See application file for complete search history.

(56) References Cited

U.S. PATENT DOCUMENTS 5,736,658 A 4/1998 Mirchandani et al.
7,490,502 B2 * 2/2009 Pauty et al. ..... 72/347

FOREIGN PATENT DOCUMENTS

CN 101573193 A 11/2009
EP 1939314 A2 7/2008
WO 2008079083 A1 7/2008

OTHER PUBLICATIONS

Kobayashi Keizo et al. Fabrication of WC-TiC based hard material by MA-PCS process:, Funtai Oyobi Funmatsuyakin. Journal of the Japan Society of Powder and Powder Metallurgy, Funtai Funmatsu Yakin Kyokai, JP, vol. 56, No. 8, Jan. 1, 2009, pp. 523-528.

* cited by examiner

*Primary Examiner* — Debra Sullivan
(74) *Attorney, Agent, or Firm* — Corinne R. Gorski

(57) ABSTRACT

The present invention relates to a punch for manufacturing of metal beverage cans of a cemented carbide comprising a hard phase comprising WC and a binder phase the cemented carbide composition comprises, in wt-%, from 50 to less than 70 WC, from 15 to 30 TiC, and from 12 to 20 Co+Ni.

8 Claims, 1 Drawing Sheet

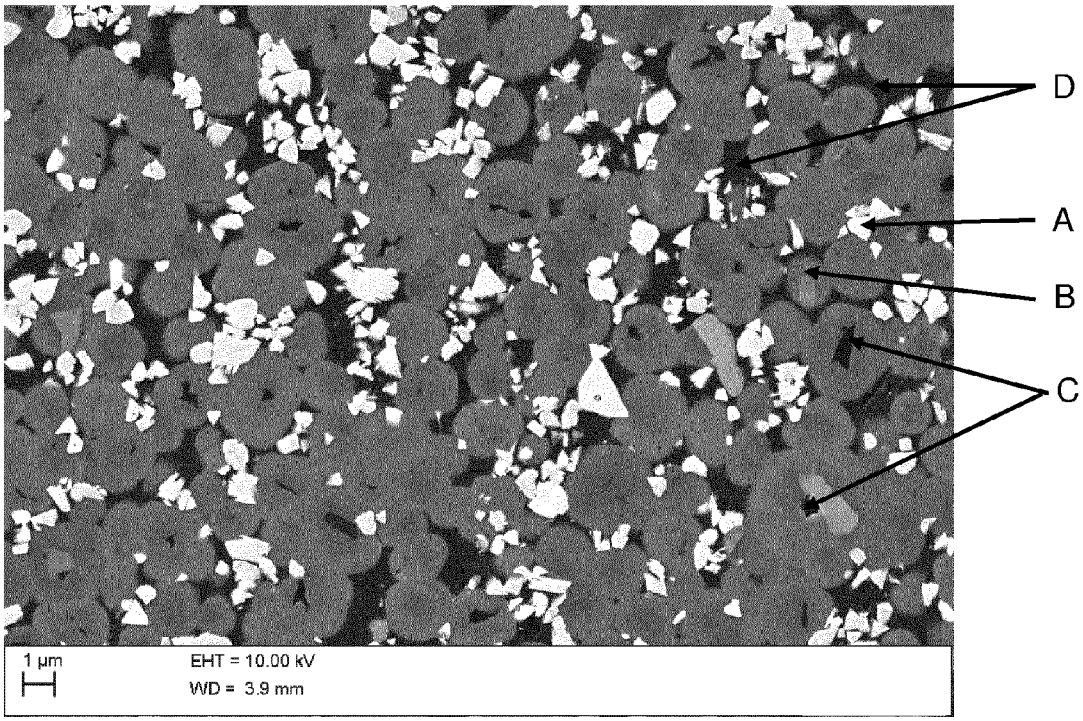
D
A
B
C
1 µm
EHT = 10.00 kV
WD = 3.9 mm

CEMENTED CARBIDE PUNCH

RELATED APPLICATION DATA

This application is a §371 National Stage Application of PCT International Application No. PCT/2011/067359 filed Oct. 5, 2011, claiming priority of EP Application No. 10186875, filed Oct. 7, 2010 and U.S. Application No. 61/392,761 filed Oct. 13, 2010.

The present invention relates to a cemented carbide tool, particularly a punch for manufacturing of metal beverage cans.

BACKGROUND

Around 260 billion cans are produced every year world wide. A single production line can make up to 500,000,000 cans per year in a continuous process from aluminium or steel strip. As an example, a cup, pressed from the metal sheet, is formed into the can body in one continuous punch stroke in about one fifth of a second, forming the inside diameter of about 66 mm, and increasing the height from 33 to 57 mm, then, through three ironing rings, to stretch the wall to 130 mm high, before forming the concave dome at the base of the can.

Due to the very tight tolerances required for the tooling (±0.002 mm) to keep the correct can dimensions, the alignment of the punch with respect to the ironing rings and dome die is critical.

The manufacture of cans is a continuous process and therefore a reliable and predictable service life between servicing is essential.

U.S. Pat. No. 5,736,658 discloses a component of tooling preferably used in the deep-drawing of aluminium and steel cans. The tooling is comprised of a nickel-bonded cemented carbide. However, as no cobalt is added to the binder phase, the grade is non-magnetic, which could be a critical drawback for the can maker that requests magnetic materials for the punch tool, and furthermore has a very low WC content to obtain a material with low density.

WO 2008/079083 discloses a punch tool of a cemented carbide containing tungsten carbide, titanium carbide, niobium carbide, cobalt and chromium together with other possible additions.

SUMMARY

It is an object of the present invention to provide a punch for manufacturing of metal beverage cans with improved service life.

It has been found that the above objective can be met by a punch of a cemented carbide comprising a hard phase comprising WC and a binder phase wherein the cemented carbide composition comprises, in wt-%, from 50 to less than 70 WC, from 15 to 30 TiC, and from 12 to 20 Co+Ni.

BRIEF DESCRIPTION OF THE DRAWINGS

FIG. 1 shows a backscattered SEM image of an exemplary embodiment of the invention wherein A is WC phase, B is (Ti,W)C cubic phase, and C is TiCx cores, D is binder phase based on Co+Ni with additions of Cr and Mo.

DETAILED DESCRIPTION

It has been found that by lowering the weight of the punch the bending moment of the ram can be significantly reduced and this will improve the alignment of the tools resulting in less vibration related to damage on the tooling, improved can wall thickness consistency, reduced bodymaker maintenance and reduced energy consumption or faster production speeds as a smaller mass is being transported. It has also been found, however, that the content of tungsten carbide and binder phase has to be kept sufficiently high in order not to sacrifice the wear resistance and toughness of the tool.

According to the invention these requirements can be fulfilled by a punch for manufacturing of metal beverage cans, such as cans of aluminium or steel, of a cemented carbide comprising a hard phase comprising WC and a binder phase wherein the cemented carbide composition comprises, in wt-%, from 50 to less than 70 WC, from 15 to 30 TiC, from 12 to 20 Co+Ni.

The sintered cemented carbide microstructure comprises WC present as an individual phase. Suitably WC is also dissolved in TiC forming a cubic (Ti,W)C phase.

It is an advantage if the sintered cemented carbide grade has a submicron or about one micron tungsten carbide, preferably having an average grain size of 0.8-2 μm, suitably 0.8-1.5 μm, as measured using the linear intercept method, to achieve sufficient wear resistance and appropriate toughness. In one embodiment, the WC phase is present in the sintered cemented carbide in the form of grains essentially all having a size less than 1 μm.

It is a further advantage if the (Ti,W)C mixed crystal phase in the sintered cemented carbide has an average grain size of 1-5 μm, as measured using the linear intercept method.

The sintered cemented carbide microstructure suitably also comprises an individual phase of Ti and C, herein after denoted TiCx. Suitably the TiCx phase is in the form of cores embedded in a cubic carbide phase comprising Ti and W.

Suitably, the cemented carbide comprises WC in amount of from 50 to 69 wt-%, suitably from 50 to 67 wt-%, more suitably 55 to 67 wt-%.

To achieve suitable magnetic properties the cemented carbide suitably comprises at least 6 wt-% Co.

The cemented carbide with Co binder only suitably has a Com value between 85.0% and 95.0% of the respective wt-% Co value to ensure that the lower limit of magnetic permeability is met and that no eta carbides is present in the microstructure. Preferably, the magnetic permeability is at least 3.5.

In practice the binder may contain Cr due to the need to achieve corrosion resistance, then this creates a non magnetic phase with the cobalt it alloys with.

Consequently a new minimum level Co wt % binder is required according to the following simple algorithm.

Minimum Co wt % (a) containing (b) Cr wt %

$$(a)=5.5+0.6\times(b)\text{ wt }\%$$

Again the latter assumes that the magnetic saturation value is between the 2-phase field, i.e., no eta carbides or graphite is present.

The operating conditions require the use of appropriate coolants that as become exhausted also become mildly corrosive in nature which can dramatically affect the wear process resulting in early failure. The coolant is a typically water based solution that exists between pH 9 when new and pH 8 when used. At the lower pH the punch tool is susceptible to corrosive wear especially with a cobalt binder. Improved wear resistance will also improve can wall thickness consistency as well as reducing tool downtime for re-grinding.

Therefore, suitably a corrosion resistant cemented carbide is used, having a base of cobalt and nickel, and further improved corrosion resistance can be achieved, e.g., by adding certain amounts of chromium, as mentioned above, and/or molybdenum to the composition.

Preferably, the cemented carbide comprises nickel and cobalt in a weight ratio Co/Ni of 0.3-2.5, suitably from 0.5 to 2.

Suitably, the cemented carbide comprises from 0.5 to 2.5 wt-% Cr, preferably 1-2 wt-% Cr.

The cemented carbide suitably comprises from 0.1-0.3 wt-% Mo.

It is an advantage if the binder phase contains between 12 and 16 wt-% Cr+Mo.

In one embodiment of the present invention, the punch comprises a cemented carbide comprising a hard phase comprising WC and TiC, and a binder phase wherein the cemented carbide composition comprises, in wt-%, from 50 to less than 70 WC, from 15 to 30 TiC, from 12 to 20 Co+Ni, with a weight ratio Co/Ni of from 0.5 to 2, from 1 to 2 Cr and from 0.1 to 0.3 Mo.

In one embodiment, the cemented carbide has a composition in, wt-%, 12-20 Co+Ni, 1-2 Cr, 0.1-0.3 Mo, 18-30 TiC and balance of WC.

In one embodiment, the cemented carbide has a composition in, wt-%, 7-9 Co, 5-7 Ni, 1-2 Cr, and 0.1-0.3 Mo, with 18-23 TiC and balance of WC.

In another embodiment, the cemented carbide has a composition in, wt-%, 6-8 Co, 12-14 Ni, 1-2 Cr, and 0.1-0.3 Mo, with 18-23 TiC and balance of WC.

In yet another embodiment, the cemented carbide has a composition in, wt-%, 10-14 Co, 5-7 Ni, 1-2 Cr, and 0.1-0.3 Mo, with 18-23 TiC and balance of WC.

In one embodiment, the punch is a can tool punch.

The invention also relates to the use of a punch according to the invention for can tool punch applications in a corrosive-abrasive environment.

The cemented carbide used in the present invention is suitably prepared from powders forming the hard constituents and powders forming the binder which are wet milled together, dried, pressed to bodies of desired shape and sintered.

Suitably at least 75 wt-%, preferably at least 95 wt-%, more preferably all, of the Ti addition to the composition is made using a raw material powder of the (Ti,W)C mixed crystal eutectic where the Ti/W weight ratio is 0.85 and the powder particles of the mixed crystal eutectic suitably have an average size ($d_{50}$) between 0.5 and 1.2 μm, preferably 0.7-1.2 μm. In one embodiment powder particles of the mixed crystal eutectic have an average size ($d_{50}$) about 5 μm meaning that suitably the particle size range is between 1 and 10 μm.

Suitably the average WC grain size ($d_{50}$) of added WC raw material powder is very similar to the (Ti,W)C mixed crystal, preferably between 0.5 and 1.2 μm, preferably 0.7-1.2 μm, more preferably about 1.0 μm.

The binder composition is chosen to keep a sufficiently high toughness and a minimum magnetic permeability. To ensure suitable corrosion resistance due to the effects of the coolant on the binder the latter is suitably formulated from a 'stainless' alloy, Example 1.

Example 1

Cemented carbide grades with the compositions in wt-% according to Table 1 were produced according to known methods and using WC and (Ti,W)C powder with an average particle size ($d_{50}$) of 0.8 μm and about 1 μm, respectively. The cemented carbide samples were prepared from powders forming the hard constituents and powders forming the binder. The powders were wet milled together with lubricant and anti flocculating agent until a homogeneous mixture was obtained and granulated by drying. The dried powder was pressed to bodies of desired shape by isostatically 'wetbag' pressed before sintering. Sintering is performed at 1410° C. for about 1 hour in vacuum, followed by applying a high pressure, 50 bar Argon, at sintering temperature for about 30 minutes to obtain a dense structure before cooling.

In certain embodiments of the invention the sole components in the composition of the cemented carbide are those listed below along with any normal minor impurities.

The sintered cemented carbide structure comprises WC with an average grain size of 1 μm, as measured using the linear intercept method.

The material has a hardness of 1250-1550 HV30 depending on the selected composition and sinter temperature.

Cemented carbide punch tool bodies fabricated according to the invention composition were tested against a previously known for can tool punches standard cemented carbide (#) according to Table 1 below.

TABLE 1

(composition in wt-%)

| Ref | A | B | C | D | # |
|---|---|---|---|---|---|
| Sample | invention | invention | invention | invention | comparative |
| WC | Balance | Balance | Balance | Balance | Balance |
| TiC* | 20 | 20 | 21 | 21 | — |
| Co | 8.0 | 8.5 | 6.0 | 12.0 | 6.6 |
| Ni | 6.0 | 5.5 | 13.0 | 6.0 | 2.2 |
| Cr | 1.5 | 1.7 | 1.7 | 1.7 | 1.0 |
| Mo | 0.2 | 0.2 | 0.2 | 0.2 | 0.2 |
| $d_{50}$ WC (μm) | 0.8 | 1.0 | 1.0 | 1.0 | 0.8 |
| $d_{50}$ (Ti,W)C (μm) | 1.0 | 1.0 | 5 | 5 | — |

*Addition using (Ti,W)C

Cemented carbide candidate grade test coupons were abrasion and corrosion tested according to ASTM standards B611, G61 and G65 (including acidic media).

Other properties have been measured according to the standards used in the cemented carbide field, i.e. ISO 3369:1975 for the density, ISO 3878:1983 for the hardness and ASTM G65 for the abrasion wear resistance.

The corrosion resistance has been characterized according to ASTM61 standard particularly suited for measuring corrosion of (Co, Ni, Fe) in chloride solution.

It could also be that a synergistic effect takes place between the abrasive and corrosive mechanisms.

The results are presented in the Table 2 below.

TABLE 2

| Ref | A | B | C | D | # |
|---|---|---|---|---|---|
| Sample | invention | invention | invention | invention | comparative |
| Density | 9.9 | 9.9 | 9.7 | 10.2 | 14.4 |
| Hardness (HV30) | 1550 | 1400 | 1250 | 1300 | 1650 |

TABLE 2-continued

| Ref | A | B | C | D | # |
|---|---|---|---|---|---|
| Toughness (K1c) $MN/mm^{1.5}$ | 9.8 | 10 | 12.5 | 12.5 | 9.6 |
| Wear resistance scar diameter (μm) EBSD at 200 mN | 2.5 | 2.5 | | | 5.0 |
| Magnetic permeability (μ) $NA^{-2}$ | 3.5-4 | 4 | >3.5 | >4.5 | 4.5 |
| Corrosion resistance* | 7.0 | 5.5 | 7.5 | 5.5 | 7.0 |
| Performance lifetime million cans | >20** | >20** | >20** | >20** | 10 |

*Breakdown potential according to ASTM61 with flushed port cell
Eb (10 $\mu A/cm^2$) normalised ranking scale 1-10 where Stainless316 = 10
**Estimated service life before re-grinding The wear resistance is increased by ×2.

The performance is estimated to increase from 10 million cans to >20 million, by more than ×2.

The invention claimed is:

1. A punch for manufacturing of metal beverage cans of a cemented carbide comprising a hard phase comprising WC and a binder phase, wherein the cemented carbide composition comprises, in wt-%, from 50 to less than 70 WC, from 15 to 30 TiC, from 0.5 to 2.5 Cr, from 0.1 to 0.3 Mo and from 12 to 20 Co+Ni.

2. A punch according to claim 1, wherein the cemented carbide composition comprises WC in an amount of from 50 to 69 wt-%.

3. A punch according to claim 1, wherein the cemented carbide comprises WC as an individual phase.

4. A punch according to claim 1, wherein the cemented carbide composition comprises from 18 to 28 wt-% TiC.

5. A punch according to claim 1, wherein the cemented carbide comprises TiCx as an individual phase.

6. A punch according to claim 1, wherein the cemented carbide composition has a weight ratio Co/Ni of from 0.3 to 2.5.

7. A punch according to claim 1, wherein the cemented carbide has a composition in, wt-%, 12-20 Co+Ni, 1-less than 2 Cr, 0.1-0.3 Mo, 18-30 TiC and balance of WC.

8. A punch according to claim 3, wherein the WC phase is in the form of grains essentially all having a size less than 1 μm.

* * * * *